US007463121B2

(12) United States Patent
D'Ostilio

(10) Patent No.: US 7,463,121 B2
(45) Date of Patent: Dec. 9, 2008

(54) TEMPERATURE COMPENSATING TUNABLE CAVITY FILTER

(75) Inventor: James D'Ostilio, Lynchburg, VA (US)

(73) Assignee: Microwave Circuits, Inc., Lynchburg, VA (US)

( * ) Notice: Subject to any disclaimer, the term of this patent is extended or adjusted under 35 U.S.C. 154(b) by 0 days.

(21) Appl. No.: 11/802,213

(22) Filed: May 21, 2007

(65) Prior Publication Data

US 2007/0241843 A1 Oct. 18, 2007

Related U.S. Application Data

(63) Continuation-in-part of application No. 10/911,574, filed on Aug. 5, 2004, now Pat. No. 7,224,248.

(60) Provisional application No. 60/582,448, filed on Jun. 25, 2004.

(51) Int. Cl.
*H01P 3/06* (2006.01)
*H01P 7/04* (2006.01)

(52) U.S. Cl. ..... 333/223; 333/207; 333/231; 333/234

(58) Field of Classification Search ..... 333/202, 333/206, 207, 219, 222–224, 226, 227, 229, 333/231, 234

See application file for complete search history.

(56) References Cited

U.S. PATENT DOCUMENTS 2,077,800 A 4/1937 Kroger
2,103,515 A 12/1937 Conklin et al.
2,315,313 A 3/1943 Buchholz
2,593,095 A 4/1952 Brehm
2,637,782 A 5/1953 Magnuski
2,998,582 A 8/1961 Riblet
3,160,825 A 12/1964 Derr
3,311,839 A 3/1967 Rutulis
3,348,173 A 10/1967 Matthaei et al.
3,448,412 A 6/1969 Johnson
3,534,301 A 10/1970 Golembeski (Continued)

OTHER PUBLICATIONS

Dale D. Henkes, Designing Short High Q Resonators, ACS, Microwaves & RF, 7 pages, Dec. 2003.

(Continued)

*Primary Examiner*—Benny Lee
*Assistant Examiner*—Kimberly E Glenn
(74) *Attorney, Agent, or Firm*—Buchanan Ingersoll & Rooney PC

(57) ABSTRACT

A high Q cavity resonator loaded with a metallic post and a ceramic disc, the resonator comprising an inner conductive post having a length less than a quarter wavelength. The resonance frequency of the resonator is tunable by changing a distance between a) an outer plate and b) a ceramic disc and an end cap where the ceramic disc is located between the outer plate and the end cap. The resonance frequency can be tuned when the outer plate, ceramic disc, and end cap are in contact with each other by varying a pressure between the contact surfaces of the ceramic disc, the end cap and the outer plate. Temperature compensation allows the resonator to hold a resonance frequency over a range of tunable frequencies despite changes in temperature, and can be achieved by selecting thermal coefficients of expansion of components holding or placing the ceramic disc and end cap relative to the outer plate.

9 Claims, 13 Drawing Sheets

U.S. PATENT DOCUMENTS 3,537,041 A 10/1970 Kommrusch
3,573,666 A 4/1971 Caffrey et al.
3,740,677 A 6/1973 Kommrusch
4,024,481 A 5/1977 Kivi
4,207,548 A 6/1980 Graham et al.
4,249,148 A 2/1981 Jachowski
4,251,787 A * 2/1981 Young et al. ..... 333/209
4,292,610 A 9/1981 Makimoto et al.
4,389,624 A 6/1983 Aihara et al.
4,462,098 A 7/1984 D'Avello et al.
4,477,786 A 10/1984 Tamura et al.
4,675,631 A 6/1987 Waggett
4,721,932 A 1/1988 West
4,730,174 A 3/1988 Nishikawa et al.
4,794,354 A 12/1988 Dinsmore et al.
4,933,652 A 6/1990 Gaukel
5,218,330 A 6/1993 Omiya et al.
5,304,968 A 4/1994 Ohtonen et al.
5,686,874 A 11/1997 Piirainen
5,754,084 A 5/1998 Hietala
5,812,036 A * 9/1998 Estrada ..... 333/202
5,963,856 A 10/1999 Kim
6,154,106 A * 11/2000 De Lillo ..... 333/210
6,300,850 B1 10/2001 Kaegebein
6,396,366 B1 5/2002 Raty et al.
6,466,110 B1 10/2002 Wulff et al.
6,496,089 B1 12/2002 Akesson et al.
6,518,858 B2 2/2003 Ando et al.
6,522,217 B1 * 2/2003 Shen ..... 333/99 S
6,600,394 B1 7/2003 Wang et al.
6,686,818 B1 2/2004 Weibler et al.
6,724,261 B2 4/2004 Cheo
7,142,837 B1 11/2006 Small
2003/0218521 A1 11/2003 Andoh

OTHER PUBLICATIONS

Levy, Yao and Zaki, "Transitional Combline/Evanescent-Mode Microwave Filters", IEEE Transactions on Microwave Theory and Techniques, vol. 45., No. 12, Dec. 1997.

* cited by examiner

TEMPERATURE COMPENSATING TUNABLE CAVITY FILTER

RELATED APPLICATIONS

This application is a continuation-in-part of U.S. patent application Ser. No. 10/911,574, now U.S. Pat. No. 7,224,248, filed in the U.S. Patent and Trademark Office on Aug. 5, 2004, which is incorporated in its entirety herein by reference, and both of which claim priority to 60/582,448, filed Jun. 25, 2004.

FIELD

The present invention relates to cavity resonators, and specifically to a single-cavity tunable filter or resonator. The present invention also relates to diplexers, duplexers, multi-section filters and combiners, which comprise the disclosed resonator.

BACKGROUND

A common cavity resonator is a quarter wave transverse-electromagnetic (TEM) coaxial resonator ("TEM resonator"). In the TEM resonator, the electric and magnetic fields lie in a transverse plane perpendicular to the conductors. The magnetic field is circular about the inner conductor. The electric field is axially symmetric about the inner conductor and extends from the inner conductor to the outer conductor. Current flows in the lengthwise direction along the surfaces of the conductors, in a direction perpendicular to both the electric and magnetic fields.

Another common cavity resonator is the waveguide cavity resonator. This type of resonator operates in a non-TEM mode, i.e., not transverse-electromagnetic. In a non-TEM mode resonator, both the electric and magnetic fields do not lie in a transverse plane perpendicular to the lengthwise conductors. In some modes, either the magnetic fields are transverse or the electric fields are transverse, but not both. A TEM mode resonator can also have waveguide modes at higher frequencies, but an empty waveguide cavity resonator cannot operate in the TEM mode. An empty waveguide guides the wave down its hollow inside from one end to another. By closing both ends of the waveguide, it resonates at frequencies determined by its inside dimensions. It has an extremely high Q and may be the highest Q cavity attainable, excluding superconductors. It is also the largest sized, at frequencies below about 1 GHz, its size generally prohibits its advantageous use.

Another cavity resonator is the evanescent mode cavity resonator. This type of resonator operates in a below cutoff waveguide cavity, i.e. below that frequency which an empty cavity would resonate. It is termed "evanescent" since the resonance is unsustainable in an empty cavity, and if excited in the empty cavity, the resonance would diminish rapidly. Above the cutoff frequency e.g., which depends on the dimensions, loading and other factors, the TEM coaxial cavity can also resonate in a waveguide mode. The evanescent mode is transitional between the TEM mode and the waveguide mode in a coaxial cavity resonator. Since it is intended to operate the cavity so that energy can be extracted from the cavity without loss of the energy into unwanted modes, prior art coaxial cavity have been designed with physical dimensions so that no waveguide modes can be excited, i.e., to operate strictly in the TEM mode.

A commonly used evanescent mode cavity is a metallic box that contains a metallic post, or dielectric resonator puck or post, or metallic post with a loading capacitor. Such posts and loading capacitors are used to lower the resonant frequency to below the frequency of the empty waveguide resonance and thereby reduce the size of the cavity. By enclosing a loading capacitor and metallic post in a below cutoff waveguide cavity, the resonant frequency is lowered, the Quality factor (Q) is raised higher than a quarterwave coaxial cavity, and the size is reduced. FIG. 8 shows an example of a conventional dielectric resonator filter, which is a ceramic puck resonating in a non-TEM mode within a below cutoff waveguide cavity.

Two common characteristics or specifications used to determine/specify the performance of a TEM resonator are the length of the resonator and the Quality factor (Q). The length is generally specified as a quarter, or three quarter wavelength. This reflects the fact that the length of the resonator post is one-fourth or three-fourths of the length of the wavelength at the resonant frequency. The resonator post is formed by electrically shorting or connecting one end of the line, and leaving the other end open or electrically disconnected. Using the above characteristics, a resonator can be designed to filter a particular frequency or range of frequencies.

The quality factor Q of the resonator describes the sharpness of the system's response to input signals. A general definition of the quality factor Q, that applies to acoustic, electrical, and mechanical systems, defines Q as equal to two times the product of the number $\pi$ (pi) and the ratio of the maximum energy stored at resonance to the energy dissipated per cycle. In an electrical circuit, energy is stored in the electric or magnetic fields associated with reactive circuit components and electrical energy is lost (to heat) whenever current flows through a resistance.

Cavity filters can be used in various devices, including voltage controlled oscillators (VCO's), pagers, Global Positioning System (GPS) systems, TV/radio/cellular/PCS communications, magnetic-resonance imaging (MRI) systems, satellite transceivers, radars, radiometers, and the like in frequency ranges from 10 MHz to 10 GHz. A variety of military systems utilize these frequencies and many must be frequency-agile. Furthermore, the increasing needs of homeland security and the more than 20 million radio users in the United States are requiring that more communications equipment be added to already over crowded sites. In addition, the private radio systems utilized by commercial and public safety industries continue to face capacity restraints.

There is an increasing need for high Q cavity resonators of reduced size to be used as filters so the space saved can be used for additional equipment. In addition, cavity resonators with higher performance and lower cost are also required in order to work in more complex communication applications, such as narrowband digital frequency hopping radios. Such cavities need to be tunable to allow frequency adjustment, and temperature stable over their tunable range. Also, such cavities need to be easily connected and tuned in multiple sections, to give higher selectivity and performance and extend downward in frequency to the 100 MHz range, or lower.

SUMMARY

The described exemplary embodiments overcome the drawbacks of conventional cavity resonators, i.e., long and tall housings, expensive metallic temperature stable materials, e.g., INVAR, poor harmonic response, narrow tuning ranges, lengthy tuning times and frequency drift due to RF induced heating, while increasing performance and reducing costs by providing a ceramic loaded, temperature compensating, tunable, cavity resonator. This is achieved by replacing a portion of the resonator with a high Quality factor (Q) ceramic capacitor, for example, a portion that functions as, or which can be modeled as, a transmission line. Because the capacitor has a higher Q than the length of transmission line section it replaces, the line can be shortened and the overall Q of the device increased. By also using a larger cavity outer diameter that is below cutoff at the highest frequency required, the Q is still further increased, and by using a larger diameter ceramic disc that is also in an evanescent mode, i.e. below its dielectric resonator mode cut off frequency, the highest Q is achieved while preserving an extended spurious free frequency range, i.e., three or more times higher than the frequency of the resonator. Constructing multiple cavities together with adjustable aperture couplings can eliminate the cables used in prior art systems that need be changed to adjust the performance for differing frequencies and bandwidths.

Moreover, if the coaxial cavity physical dimensions, shape and dielectric constant of ceramic and other known factors are chosen such that a waveguide mode is not too far below cutoff, energy is coupled into and out of the cavity without exciting the waveguide mode, and the electromagnetic fields take on the configuration more of the waveguide mode than the TEM mode. The advantageous property of this evanescent mode is that the magnetic field configuration shows less variation in the lengthwise direction along the post, unlike the quarter wave coaxial cavity, and the electric field configuration is spread out over the entire ceramic disc, even far extended from the conductive end cap, similar to that of the dielectric resonator. Thus, they utilize the cavity volume in a more efficient field distribution, to achieve higher Q. The resultant Q is higher than the conventional TEM mode and approaches the very high Q of the waveguide mode.

According to an exemplary embodiment, the cavity resonator comprises an inner conductive post, an end cap positioned over an end of the conductive post, a ceramic disc, and a top plate, of which the ceramic is positioned between the end cap and top plate. The frequency of the cavity is adjusted by increasing/decreasing the distance between the surface of the end cap and the surface of the top plate. In another exemplary embodiment, the ceramic is not voltage tunable.

The ceramic dielectric temperature coefficient and the holding mechanism coefficient of expansion can be selected to compensate for any change in length of the inner post length and outer cylindrical cavity length. The frequency temperature stability of an exemplary embodiment over −30 C to +60 C is less than 2 ppm/C at 250 MHz, where ppm is parts per million and C is degrees Centigrade.

BRIEF DESCRIPTION OF THE DRAWING FIGURES

A more complete understanding of the exemplary embodiment may be derived by referring to the detailed description and claims when considered in connection with the Figures, wherein like reference numbers refer to similar items throughout the Figures.

DETAILED DESCRIPTION

In the following description, for purposes of explanation and not limitation, specific details are set forth, such as particular circuits, circuit components, techniques, and the like in order to provide a thorough understanding of the present invention. However, it will be apparent to one of ordinary skill in the art that the disclosed embodiments may be practiced in other embodiments that depart from these specific details. In other instances, detailed descriptions of well-known methods, devices, and circuits are omitted so as not to obscure the description of the disclosed embodiments with unnecessary detail.

A cavity resonator in its most basic form is a (short) transmission line/capacitor circuit. In the broadest sense, a transmission line is anything that electrically connects a load to a (voltage and/or current) source. Depending on characteristics of the signals, for example, frequency and amplitude, carried or conveyed by the transmission line, different features or characteristics of the line become important. One characteristic of a length of transmission line is its Quality factor (Q), which is based on the impedance, outer diameter, conductivity, surface roughness, temperature and length of the transmission line. The impedance is proportional to the logarithm of the diameter ratio of the outer cylinder inside diameter to the inner coaxial post outer diameter.

The capacitance of the cavity resonator can be provided by a dielectric parallel plate capacitor. The capacitance allows the transmission line to resonate at a particular frequency, and changing the capacitance will change the resonant frequency of the transmission line, or the frequency at which the transmission line resonates. Thus, by selecting or adjusting the capacitance, a desired resonant frequency can be achieved.

Unlike conventional, high Q evanescent and TEM mode cavity resonators, which have a large gap between the end of the inner coaxial post and the outer ground plate, a resonator in accordance with exemplary embodiments of the present invention is loaded or provided with a ceramic disc. Specifically, some length of the resonator transmission line is replaced with a high Q ceramic capacitor. Because the capacitor has a higher Q than the length of the transmission line section it replaces, the line can be shortened and the overall Q of the device can be increased.

Figure 1:
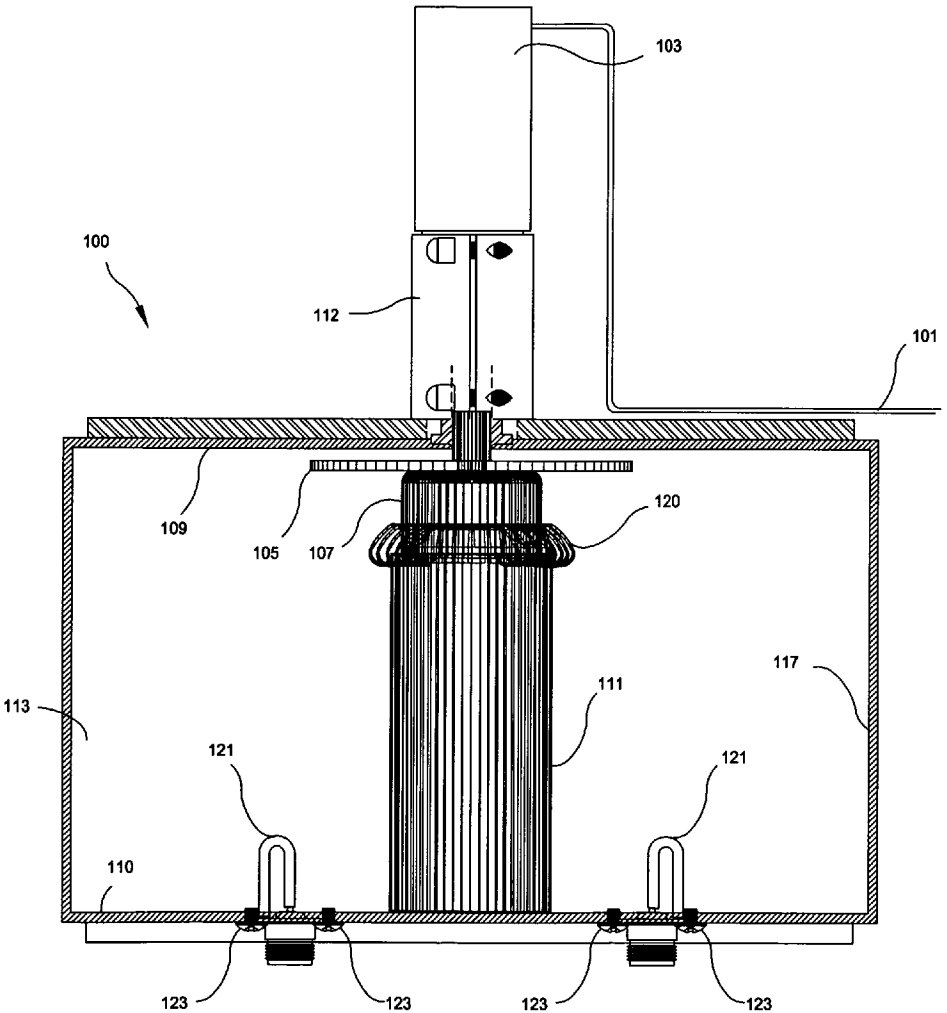
FIG. 1 is a cross sectional view of a servomotor tuned resonator according to an exemplary embodiment.

FIG. 1 illustrates a cavity resonator 100 according to a first embodiment of the invention. The resonator 100 includes a cavity 113 formed between an outer cylinder 117, a top plate 109 and mounting plate 110. An inner post 111 includes contact fingers 120 that electrically connect the inner post 111 to an end cap 107. The end cap 107 can, for example, be made of copper, and can be silver plated. A ceramic disc 105 is located between the end cap 107 and the top plate 109. At least the surfaces of the end cap 107 and the top plate 109 are electrically conductive. Also shown in FIG. 1 is a shaft collar 112, which can be a locking shaft collar and which can, for example, be made of steel or any other suitable material. A servomotor 103 is also provided, and can be actuated via wires 101.

The conductive surfaces of the end cap 107 and the top plate 109 are held parallel at a distance, and together with the ceramic disc 105 form a capacitor. The capacitance of the capacitor varies with a distance between the conductive surfaces of the end cap 107 and the top plate 109. Bringing these closer together increases the capacitance, which lowers the center or resonance frequency. Conversely, moving the conductive surfaces of the end cap 107 and the top plate 109 further apart reduces the capacitance and increases the resonance frequency of the resonator 100. Therefore, the resonance frequency of the resonator 100 can be varied or controlled by controlling the distance between the conductive surfaces of the end cap 107 and the top plate 109.

The end cap 107 and the top plate 109 can be highly conductive in order to achieve a very high capacitor Q, which improves the resonator's performance in high power (i.e., large current) applications as well as in high selectivity filter applications. Couplings 121 facilitate input and output of signals and are held in position by screws 123.

Figure 2:
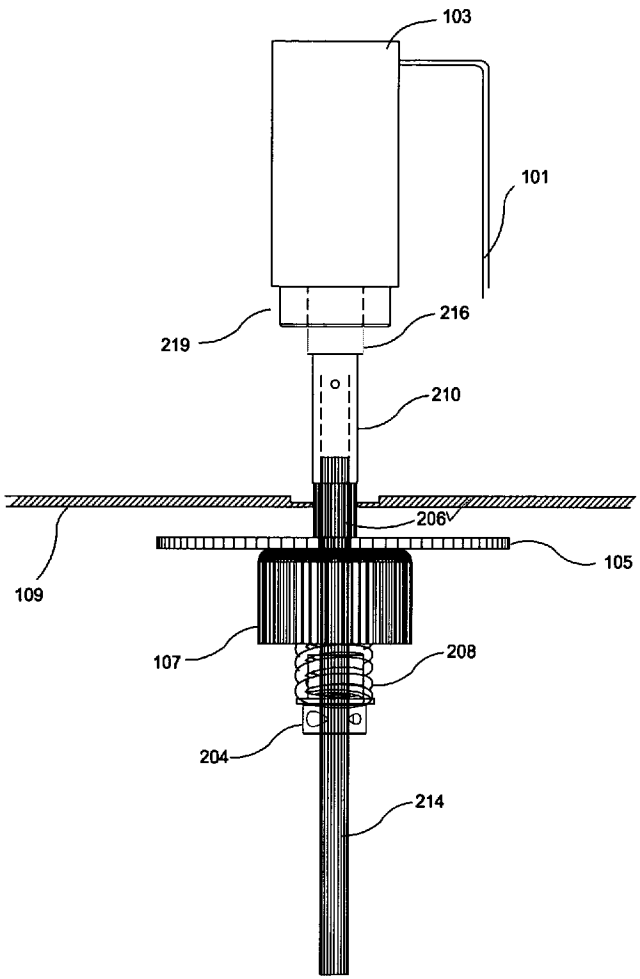
FIG. 2 is a magnified cross sectional view of the resonator of FIG. 1 from the end cap through the top plate.
Figure 3:
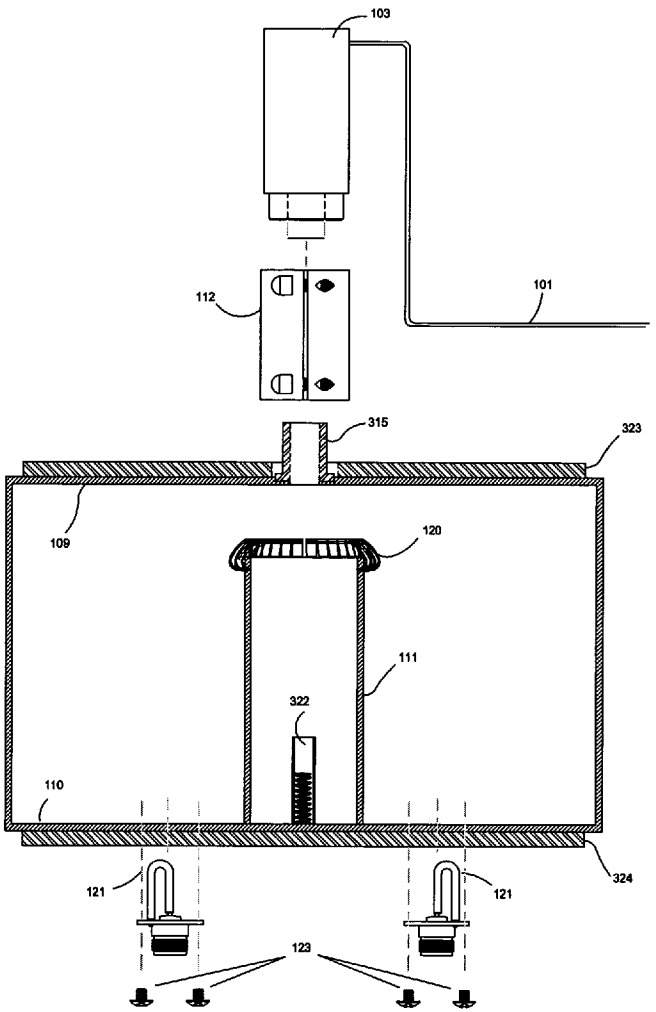
FIG. 3 is an internal view of the resonator of FIG. 1.

As shown in FIGS. 1-3, within the resonator is a rod 214 (which can, for example, be made of alumina) supported at one end by a first bushing 322 attached to bottom plate 110, and at the other end by a second bushing 315 mounted on the top plate 109. An inner post 111 extends along at least part of the length of the rod 214 while the end cap 107 is pressed against the ceramic disc 105 along the non-conducting rod 214 by a spring 208. As used herein, the terms "non-conducting" or "non-conductive" refer to dielectric materials such as plastics and ceramics (e.g., alumina) that exhibit low-loss or low absorption attributes when subject to radio frequency energy. In FIG. 2, the spring 208 is compressed between the end cap 107 and a shaft collar 204 mounted to the rod 214, and pushes the end cap 107 toward the ceramic disc 105. Because the ceramic disc 105 is only in contact with the end cap 107 by pressure of the spring 208, the disc 105 is free to expand axially in opposition to the spring pressure due, for example to thermal expansion. This can increase durability or longevity of the resonator 100, and, in particular, of the ceramic disc 105 by reducing strains induced by differing expansion rates/thermal coefficients of expansion of various components in the assembly, for example, the ceramic disc 105, the end cap 107, the rod 214, and so forth.

In addition, allowing the ceramic disc 105 to expand and contract with changes in temperature can result in a corresponding change in distance with temperature between the opposite conducting surfaces of the end cap 107 and the top plate 109, which helps stabilize the resonant frequency of the resonator 100 across different temperatures.

Signal loss or attenuation along a length of coaxial transmission line is measured at a certain rate per unit length. As is the case with a straight wire transmission line, the longer the length, the greater the loss. The loss also increases in proportion to the square root of the frequency of the signal being transmitted through the transmission line. This holds true for coaxial cable, inductors, or a single wire, as a result of the skin effect at Radio Frequency (RF) frequencies, for example, frequencies ranging from 10 kHz to 300 MHz. This loss is dissipated as heat by the current-carrying conductors. In other words, the lost signal energy shows up as waste heat in the current-carrying conductors of the transmission line.

Loading or equipping a coaxial transmission line with a capacitance to form a resonator reduces the loss from the line, but the overall loss of the resonator will increase unless the loading capacitor Q is of the order of the Q of the line. However, the harmonic response of the line is extended according to the amount of the shortening of the line, independent of Q. For example, the signal frequency determines the wavelength of the signal, and the relation of the signal wavelength to the length of the transmission line influences the harmonic response of the transmission line.

High Q loading of a transmission line has been difficult to realize in the past, as the typical air capacitor Q is much lower than the coaxial line Q due to the very small air gap required to realize the capacitance (the air gap usually being much less than the distance between the inner conductive post 111 and outer cylinder 117). Additionally, the small air gap may cause flashover sparking and resultant breakdown under power.

Accordingly, thin, small-diameter ceramic substrates which reduce the length of a coaxial post have been used to increase the flashover voltage handling and produce extended stop band performance filters at the expense of Q. Additionally, the electrical currents flowing on the plates of the capacitor cause loss, which in turn results in RF-induced heating of the plates.

In the prior art, metallization schemes such as deposited thin films or silver fired conductors have been applied directly to the plates of the capacitor substantially increasing these losses. In accordance with exemplary embodiments of the present invention, highly conductive silver-plated copper material can be provided abutting the ceramic disc 105 or near the ceramic disc 105, dramatically reducing such losses.

Figure 4:
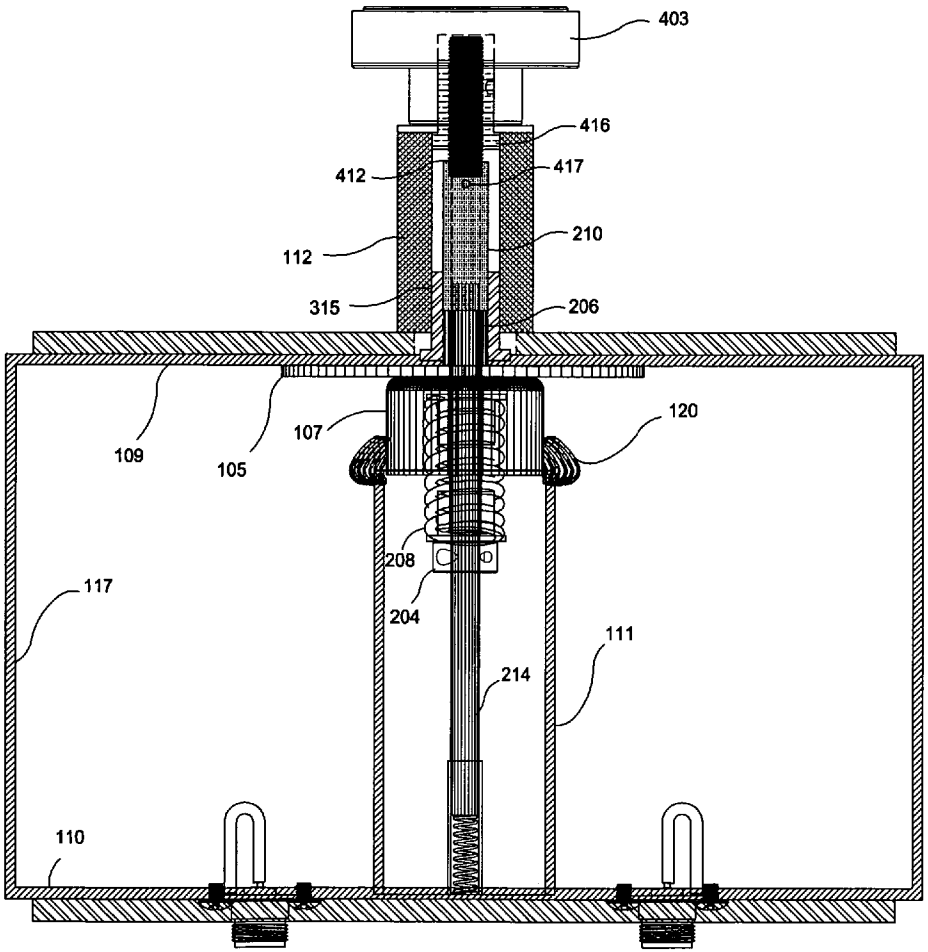
FIG. 4 is a cross sectional view of a mechanically-tuned resonator in accordance with another embodiment.

Describing the resonator 100 now in greater detail, the resonator can be formed by shortening a cavity filter to less than a quarter wavelength, by replacing some length of the transmission line with a high Q capacitor such as the ceramic disc 105 which is below its dielectric resonator cutoff frequency, and increasing the diameter of the outer conductor 117 to be just below waveguide cutoff at the highest frequency required to be suppressed. Exemplary cavity filters are shown in FIGS. 1 and 4. Note that the inner post 111 forms part of the transmission line length. Replacing a portion of the inner post 111 with the ceramic disc 105 shortens the transmission line length, and also increases the overall Q of the resonator, because the ceramic disc 105 has a higher Q than the transmission line, such as inner post 111, and because shortening the transmission line raises the Q of the transmission line. Factors such as increasing the diameter of the outer conductor 117 increases the Q proportionally in a TEM mode coaxial cavity, and Q is further increased in the below cutoff waveguide mode. For example, doubling the outer conductor 117 diameter as well as other factors more than doubles the Q of the line, so long as the diameter of the outer conductor 117 is less than that which would produce degenerate waveguide modes. Factors such as increasing the diameter and thickness of the ceramic disc 105 increases the Q of the capacitor by being in an evanescent dielectric resonator mode.

The quality factor Q of a resonant electromagnetic system can be defined as the product (at resonance) of the angular frequency ω and the ratio of the total energy stored in the system to the power dissipated or otherwise coupled out of the system.

$$Q=\omega*\text{energy stored/average power loss}$$

Or written as:

$$Q=\tfrac{1}{2}(\text{Sum of reactances}+\omega*\text{sum of }|dX/dw|)/\text{sum of resistances} \quad (1).$$

Where
Q=Quality factor,
X=reactance,
ω=2*pi*f,
f=frequency.

The input impedance of a low loss transmission line shorted at one end is
Z=Zo tan*h*(al+jBl)=R+jX,
R=Zo sin*h*(2al)/(cos*h*(2al)+cos(2Bl)),
R is approximately=Zo sin*h*(2al)/(1+cos(2Bl)),
X=Zo sin(2Bl)/(cos*h*(2al)+cos(2Bl)),
and X is approximately=Zo tan(Bl).

where
a=line attenuation (Nepers/m),
B=ω/c
l=line length (l<¼ wavelength),
c=propagation velocity of light,
R=series equivalent resistance,
Zo=impedance of the line.

Equating the reactance of the resonating capacitance to the reactance of the line at the resonant frequency gives:

$$X=Zo\ \tan(Bl)=1/(\omega C)$$

$$\text{Or } C=1/(2\ \text{pi}\ f\ Zo\ (\tan(Bl)),$$

Where
C=Capacitance.

The reactance of the capacitance is equal to the reactance of the line at the resonant frequency, and therefore solving for C in the above equation determines the capacitance required to resonate the shortened transmission line at frequency f.

Thus the Q of a shortened length of transmission line is:

$$Q=\tfrac{1}{2}(\tan(Bl)+Bl/\cos{**}2(Bl))/(\sin h(2al)/(\cos h(2al)+\cos(2Bl)))$$

The Q of a full-length (quarter-wave) resonator thus reduces to:

$$Q=2.1715*\text{pi}/(Ax)$$

where
A=the line loss dB/inch,
and x=the quarter wavelength in inches.

Extrapolating the transmission line length to zero in a limiting sense, the Q of the shortened transmission line section approaches double that of the quarter wavelength line.

Using a shortened length of line in series with a capacitor with a Q value equal to the shortened line, the resonant circuit Q is equal to the shortened line itself. Thus the Q of the now shortened transmission line and capacitor circuit is more than that of the quarter wavelength line.

The above does not account for the losses and resulting lower Q due to the shorting bottom plate 110, but this plate is made of highly conductive copper, and may be polished and silver plated to minimize those losses.

By way of example, a conventional unloaded quarter wavelength coaxial cavity constructed from a section of ANDREW's MAXCLine™, where the published line loss of a 6 inch air line cable is 0.036 dB/100 feet at 55.25 MHz with a wavelength in inches of 213.774, results in a quarter (¼) wavelength Q of 4,255. Shortening this line to ⅛ wavelength, raises the Q of the line to 6,964, and adding a load of a resonating capacitor with a Q of 20,000 yields an overall Q of 9,742, over twice as large a Q in half the volume.

This same cable at 801 MHz has a loss of 0.142 dB/100 feet with a wavelength of 14.74 inches and a Q=15,644. Shortening this line to ⅛ wavelength raises the Q of the line to 25,603 and loading it with a resonating capacitor having a Q of 40,000 yields an overall Q of 30,389.

From the above, the Q of an 800 MHz ¼ wave coaxial cavity made from a 6" diameter copper cylinder was determined to be 15,644. Shortening that resonator to ⅛ wavelength with a loading capacitor Q of 40,000 yielded a cavity Q of 30,389. The theoretical Q of an 800 MHz copper cylinder waveguide cavity in the $TM_{010}$ mode of roughly 11 inches diameter and height is 42,400. Here using the industry standard notation of the field configurations as $TM_{1,m,n}$, where 1 is the integer number of full-period variations azimuthally, m is the integer number of half-period variations radially, and n is the number of half-period variations longitudinally.

If the 6" diameter of the ¼ wave cavity is doubled to 12", its Q would theoretically double to 15,644×2=31,288. The loaded cavity Q would not double from 30,389 since a large portion of its Q is due to the Q of the loading capacitor, but does increase due to the larger outer cylinder diameter raising the Q of the line just as in the ¼ wave cavity, then further again by having an evanescent mode field configuration. The loaded cavity still has less Q than the empty waveguide cavity's Q of 40,217, but approaches it as the Q of the capacitor increases.

The diameter of the outer cylinder of the evanescent mode loaded cavity must be chosen to be below cutoff frequency at the first waveguide mode, which frequency is approximately 11.8/(b−a), where b is the inside diameter of the outer conductor 117, which in this case is cylindrical, and a is the outer diameter of the inner cylinder 111, a and b are in units of inches and frequency is in GHz. The inner post diameter dimension a, preferably, being chosen for the internal impedance desired. The length dimension does not affect the first waveguide mode, since we are less than ¼ wave height or less. Thus, giving the same rejection to harmonic frequency responses as the loaded cavity.

High-Q ceramics with Qs in excess of 20,000 to 40,000 at 1 GHz are now readily available. Therefore, at RF frequencies it can be a prime concern to replace a length of the coaxial conductor with a high Q capacitance to form a resonator, and increasing the diameter, and thereby increasing the overall Q of the device, while reducing its length.

Shortening the length of the transmission line can provide additional benefits by further extending the harmonic frequency response of the line. For a ¼ wavelength line, this occurs at the ¾ wavelength frequency or at 3 times the center (or resonant) frequency. Shortening this line in half, doubles that to 6 times the center frequency. This further extends the range at which interfering signals interact with the device.

Referring back to FIG. 1, the transmission line length of the resonator 100 is the surface length from the top of the end cap 107 to the mounting plate 110. Expansion of the shortened inner post 111 (e.g., thermal expansion) within the cavity 113 is a concern because the transmission line length due to the post 111 lengthens and lowers the resonant frequency during expansion. Expansion of the end cap 107 likewise is of concern, since within the cavity 113, the transmission line length due to the end cap 107 lengthens and lowers the resonant frequency during expansion. Merely keeping the line length constant with temperature, as in the prior art, will not alone maintain temperature stability of the resonator 100 because the distance from the end cap 107 to top plate 109 (which determines the capacitance of the transmission line load) also must be controlled so as not to change the resonant frequency of the resonator 100.

Figure 7:
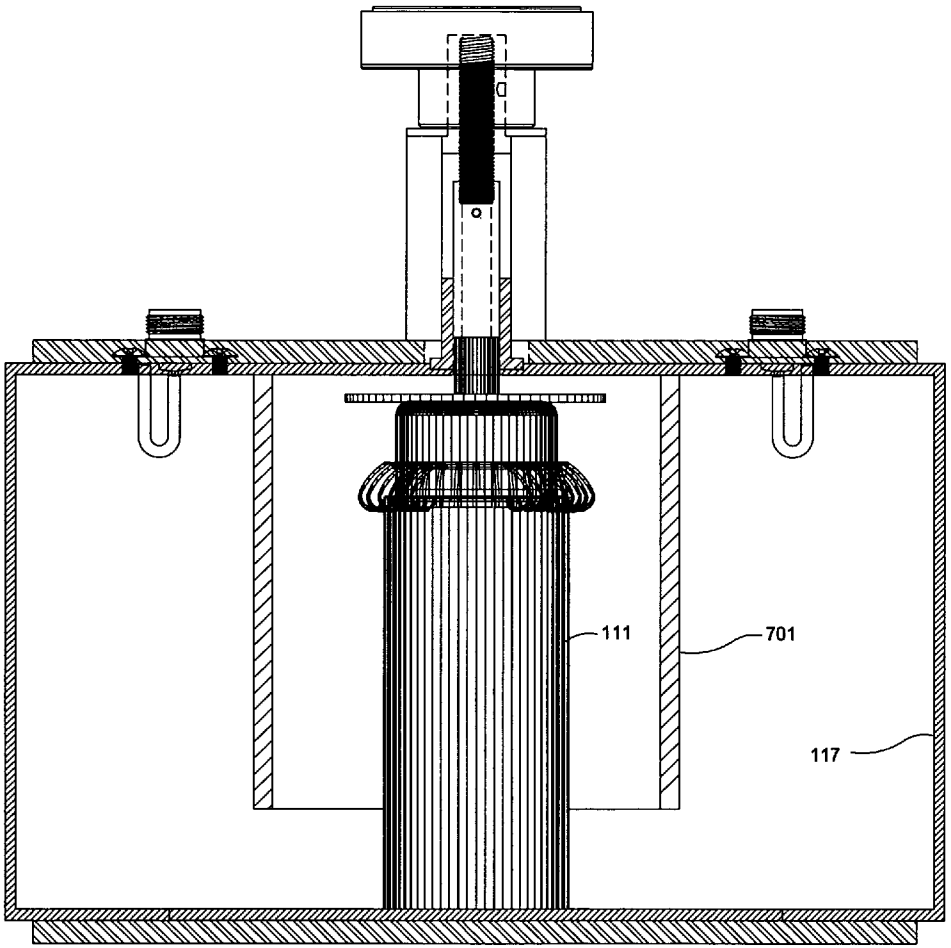
FIG. 7 is an exemplary cross section view of an interlaced post resonator in accordance with an exemplary embodiment.
Figure 8:
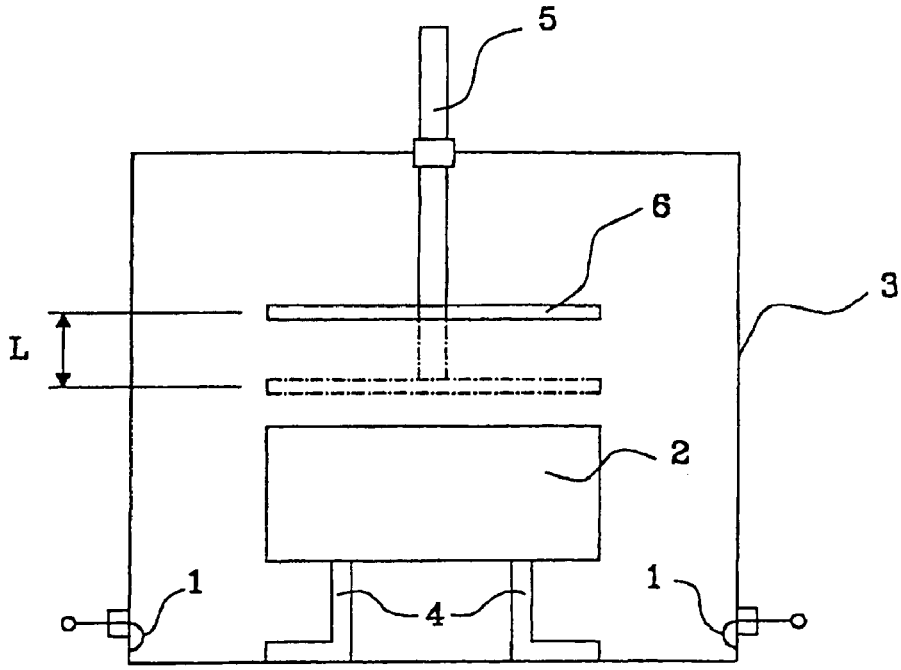
(PRIOR ART) FIG 8
FIG. 8 is a conventional resonator.

To even further reduce the resonant frequency of the cavity, we interlace two posts within the cavity, 701 and 111, respectively, shown in FIG. 7, which effectively lowers the resonant frequency by approximately 25%. This can be done without the added need for a longer outer cylinder length.

In an exemplary embodiment, as shown in FIG. 3, the contact fingers 120 are soldered to the outside of the shortened inner post 111 and for constant electrical contact are soldered to the outside of the end cap 107 to allow for expansion in the length of the outer conductor 117 while maintaining electrical contact over the tuning range. In an exemplary embodiment, the contact fingers 120 are, preferably, silver plated and constructed of highly conductive Beryllium copper material to flex with variations in temperature and movement of end cap 107 during tuning. Other suitable materials and attachment methods can be used to form constant electrical contact between the inner post 111 and the end cap 107.

The inner post 111, end cap 107, and outer cylinder 117, are each constructed of a highly conductive material, for example, copper. The inner post 111, the end cap 107, and the outer conductor 117 can be constructed of the same material or of different materials having substantially the same coefficient of the thermal expansion, to result in matched expansion/contraction of the inner post 111, end cap 107 and outer conductor 117 diameters with variations in temperature. In an exemplary embodiment, inner post 111, end cap 107, and outer conductor 117 components are constructed of a highly conductive material. Alternatively, they can be constructed from laminates with steel, with different linear coefficients of expansion, and change of impedance is a factor affecting the resonant frequency of the coaxial resonator 100 with temperature that can be considered in determining the resonance frequency temperature stability of the resonator. As shown in FIG. 3, steel laminate plates 323 and 324 are used to stiffen top plate 109 and bottom plate 110 and allow the use of less expensive thinner copper material for top plate 109 and bottom plate 110, while reducing the linear coefficient of expansion. Laminates of copper on steel or heavily plated ceramics with low coefficients of expansion could also be used for inner post 111, outer cylinder 117 or end cap 107.

According to a first embodiment shown, for example, in FIGS. 1 and 2, frequency tuning is preferably performed by a servomotor 103 acting on a movable shaft 216, which is clamped or otherwise attached to the expansion tube 210. The movable shaft 216 can be made of steel or some other wholly or partially ferromagnetic material or structure. As shown in FIG. 2, the ceramic disc 105, top plate 109, and end cap 107 are positioned surrounding the non-conductive rod 214, which can be made of alumina. The ceramic disc 105 is sandwiched between the movable shaft 216, an expansion tube 210 which, for example can be made of aluminum, a spacer 206, which can be made of alumina or other suitable non-conductive material, the end cap 107, a spring 208, and the shaft collar 204. The shaft collar 204 is clamped or otherwise attached to the rod 214 so that the shaft collar 204 does not move along the long axis of the rod 214.

Referring to FIGS. 2 and 3, the position of the servomotor 103 is fixed relative to the top plate 109 via the locking shaft collar 112 and the bushing 315. Accordingly, when forces generated by the servomotor 103 move the movable shaft 216 and also the rod 214 relative to the servomotor 103, the distances from the top plate 109 to the ceramic disc 105 and the end cap 107 change until the ceramic disc 105 comes into contact with the top plate 109. After the ceramic disc 105 is in contact with the top plate 109, then further movement of the rod 214 that brings the shaft collar 204 closer to the top plate 109 compresses the spring 208 and increases the pressure between opposing contact surfaces of the ceramic disc 105 and the top plate 109. This is because the shaft collar 204 and movable shaft 216 are fixed along the long axis of the rod 214, and the spring 208, end cap 107, ceramic disc 105, spacer 206, and expansion tube 210 are arranged between the shaft collar 204 and movable shaft 216. The spring 208 presses the end cap 107, ceramic disc 105, and spacer 206 against the expansion tube 210 attached to movable shaft 216, so that that when the movable shaft 216 moves with respect to the coil 103, they move also. As explained above, the servomotor 103 is fixed in position relative to the top plate 109 via the locking shaft collar 112 and the bushing 315. Thus, when the servomotor 103 moves the movable shaft 216, the distances from the top plate 109 to the ceramic disc 105 and the end cap 107 will change until the ceramic disc 105 comes into contact with the top plate 109, which changes the capacitance between the ceramic disc 105, end cap 107 and top plate 109.

In an exemplary embodiment, the capacitance varies greatly with a small change in the gap distance between end cap 107 and top plate 109, and this allows the filter resonant frequency to be tuned more quickly and over a greater frequency range than can be achieved by lengthening rods in conventional tunable cavity filters.

The ceramic disc 105 is in direct contact with the end cap 107, which contacts through spring fingers 120 to the inner post 111. For a given setting or energization level of the servomotor 103, the rod 214 will tend to move as controlled by the servomotor 103, the ceramic disc 105 and end cap 107 can move relative to the inner post 111 when the outer conductor 117 thermally expands or contracts lengthwise. The expansion and contraction can be considered in determining the resonance frequency temperature stability of the resonator.

Furthermore, heat is conducted through the ceramic disc 105 to the top plate 109. Thermal expansion of the top plate 109 as well as of the outer conductor 117 increases the return current path along the top plate 109 and outer conductor 117, and thereby increases an inductance of this return current path. Compensating for this thermally-induced inductance change can stabilize the frequency of the resonator over a broad temperature range.

Heat is also conducted to the spacer 206 and the expansion tube 210 via the ceramic disc 105, the top plate 109 and the bushing 315, as shown in FIGS. 2 and 3. The distance from the end cap 107 to the top plate 109 can be controlled (when the ceramic disc 105 is not contacting the top plate 109) by providing a differential thermal expansion of a) the spacer 206, the expansion tube 210 and movable shaft 216, on the one hand (which by lengthening pushes the ceramic disc 105 further away from the top plate 109), and b) the bushing 315, the "adjusted" length of the shaft collar 112 between the housing 219 of the servomotor 103 and the bushing 315, and the housing 219 of the servomotor 103 on the other hand (which by lengthening moves the servomotor 103 and the movable shaft 216 away from the top plate 109 and thereby draws the ceramic disk 105 closer to the top plate 109). Absent adjustments of the locking shaft collar 112 relative to the housing 219 of the servomotor 103 (e.g. by sliding the servomotor housing 219 further into or out of the shaft collar 112 ), the top plate 109, the bushing 315, the locking shaft collar 112, and the servomotor 103 housing 219 have fixed positions relative to each other (not counting thermal expansion of the components themselves) and have a constant effective length that is subject to thermal effects. Thus, the bushing 315 and locking shaft collar 112 will tend to respond in the same way to thermal activity regardless of a distance between the top plate 109, and the ceramic disc 105. In contrast, when the ceramic disc 105 is further from the top plate 109 the expansion tube 210 will be closer to thermal activity, i.e., higher temperature gradients (caused by high power RF heating of end cap 107 and disc 105), for example, at the top plate 109 and the bushing 315, and when the ceramic disc is closer to the top plate 109, the expansion tube 210 will be further from this thermal activity. Of course, components that are further from the thermal activity can be less affected by it. For example, the bushing 315 will be more affected than the servomotor housing 219. The servomotor housing 219 can, for example, be made of steel, or any other material having structural qualities necessary to support function of the servomotor 103 and provide a desired or acceptable coefficient of thermal expansion.

Also, when the ceramic disc 105 is further from the top plate 109, its temperature expansion effect is less because its percentage of the total loading capacitance at that distance is less. When the ceramic disc is closer to the top plate 109, the contribution to the temperature stabilization of the capacitance by the ceramic disc 105 has an increasing temperature stabilizing effect. This can also be the case when there is not any substantial temperature gradient, such as when the filter is implemented as a receiver.

Referring to FIG. 1, recall that when the outer conductor 117 expands, the inductance of the resonator 100 increases and correspondingly the capacitance must be reduced the same, so the resonant frequency of the resonator 100 is maintained. Recall also that the relationship between capacitance and distance from the top plate 109 to the disc 105 is inverse and nonlinear, so decreasing the separation distance between the ceramic disc 105 and the top plate 109 increases the capacitance. A small decrease in distance between the ceramic disc 105 and the top plate 109 results in a greater increase in capacitance when the disc 105 is close to the top plate 109 than when the disc 105 is further from the top plate 109.

Referring back to FIGS. 2 and 3, in an exemplary embodiment, the overall thermal coefficient of expansion of the expansion tube 210 and the spacer 206 and movable shaft 216 is greater than that of the bushing 315, shaft collar 112, and servomotor housing 219. Thus, when temperature increases, the net effect of expansion of the expansion tube 210, spacer 206, movable shaft 216, bushing 315, shaft collar 112, and servomotor housing 219 is to increase the distance between disc 105 and the top plate 109, thereby lowering the capacitance of the resonator 100 and compensating for the inductance increase caused by greater return current path length due, for example, to thermal expansion of the top plate 109 and the outer cylinder 117. With more of movable shaft 216 extended or closer to the top plate 109, the effect of expansion of movable shaft 216 is greater, since it has more length to expand and this variable length of movable shaft 216 compensates for the non-linear variation of the capacitance with distance between the top plate 109 and end cap 107.

In an exemplary embodiment, the thermal coefficients of expansion of the spacer 206, the expansion tube 210 and movable shaft 216 can be selected to match the non-linear relationship between capacitance of the resonator 100 and distance separating the disc 105 from the top plate 109 to any desired degree. Lengths and relative lengths of the spacer 206 and expansion tube 210 and movable shaft 216 can also be selected to adjust distances of the tube 210 from the top plate 109 and adjust proportional effects of expansion of the spacer 206 and expansion of the tube 210. In an exemplary embodiment, the thermal coefficient of expansion of the expansion tube 210 is not greater than that of the spacer 206 so the non-linear relationship of capacitance to separation distance is not compensated, even though the capacitance will still change with temperature to compensate for change in inductance with temperature albeit to perhaps a lesser degree of accuracy.

Note that when the ceramic disk 105 is in contact with the top plate 109, the expansion of the rod 214 between the shaft collar 204 and expansion tube 210 will tend to decrease contact pressure between the ceramic disc 105 and the top plate 109, whereas expansion of the shaft collar 112 and the bushing 315 will tend to increase contact pressure between the disc 105 and the top plate 109.

When the disc 105 and the top plate 109 are separated by a non-zero distance, capacitance and resonant frequency of the ceramic loaded resonator 100 are primarily determined by the dielectric of the ceramic disc 105 and the distance from the top surface of end cap 107 through the ceramic disc 105 to the top plate 109. When the ceramic disc 105 is in contact with the top plate 109, capacitance of the resonator can also be determined or affected by a contact pressure between surfaces of the disc 105 and the top plate 109. The finish and shape of end cap 107, the ceramic disc 105 and the top plate 109 can be a factor in producing the proper capacitance. For instance, the finish can be etched, non-uniform or rough, and the shape can be warped, curved and asymmetrical.

Exemplary embodiments can have one or both of a) an adjustable non-zero distance between the disc 105 and the top plate 109, and b) an adjustable pressure between the disc 105 and the top plate 109 in contact with each other. Thus, in some embodiments, the disc 105 is never in contact with the top plate 109; in other embodiments, the disc 105 is always in contact with the top plate 109; and in yet other embodiments, the disc 105 can be in contact or not in contact with the top plate 109.

When the disc 105 is in contact with the top plate 109, the resonant frequency can be adjusted by changing a contact pressure between the contact surfaces of the disc 105 and the end cap 107, and the contact surfaces of the disc 105 and the top plate 109. When a force squeezing the disc 105 between the end cap 107 and the top plate 109 is increased, the actual contact area of the opposing surfaces increases, which increases capacitance. Thus, the actual force holding the top plate 109 and the end cap 107 against the ceramic disc 105 affects the capacitance and thereby the resonant frequency of the resonator 100.

Since in an exemplary embodiment, the surfaces of the ceramic disc 105 and the conducting plates of end cap 107 and top plate 109 are not perfectly flat, pressing the surfaces together with greater force increases contact surface area, thus increasing the capacitance. This increased capacitance lowers the center or resonance frequency. Accordingly, the resonant frequency of the resonator 100 can be varied or adjusted by varying an amount of pressure between the contact surfaces of the dielectric disc 105 and the surfaces of the conducting plates, i.e., end cap 107 and top plate 109, or by varying an amount of force applied to the end cap 107 and top plate 109.

Referring to FIG. 4, which shows an exemplary embodiment having a knob 403 fastened to a threaded nut 416 that in turn has threads mated to a screw 412 that is attached to the expansion tube 210. When the knob 403 is turned, the mated threads move the screw 412 (and the rod 214 and attendant assemblies) closer to or further from the top plate 109. When the end cap 107, disc 105 and top plate 109 are in contact, further turning the knob 403 on threaded nut 416 causes the screw 412 to pull the rod 214 and attached shaft collar 204. This further compresses the spring 208 against the end cap 107 which in turn presses the ceramic disc 105 against the top plate 109.

In an exemplary embodiment, the maximum force applied to squeeze the disc 105 between the end cap 107 and the top plate 109 is preferably less than 100 lbs. This relatively low force acting over the broad surface area of the ceramic disc 105 does not deform the disc 105 nor the surfaces of the top plate 109 or end cap 107 but they are simply strained to conform with each other under compression. The end cap 107 can slide along the rod 214 and relative to the inner post 111 with little friction and the contact fingers 120 soldered to the stationary center conductor post 111 maintain electrical contact between the end cap 107 and the inner post 111 with minimal friction, so as not to significantly affect the pressure applied to press the end cap 107, disc 105 and top plate 109 together.

As a result, to tune the resonant frequency in a range that can be provided with the disc 105 in contact with the end cap 107 and the top plate 109 (which includes the greatest capacitance and thereby the lowest resonant frequency of the resonator 100), compressive force is applied to modulate the contact surface pressure and consequent actual contact surface area between the ceramic disc 105, the end cap 107 and the top plate 109. This allows the resonator frequency to be tuned without the need for resonator components to move large distances, which allows for quicker frequency variation than can be achieved in conventional tunable cavity filters.

To allow frequency hopping in hostile environments for long range communications that make use of the HF/VHF/UHF spectrum, for example, in combat radio systems, the tuning speed of the resonator must be as quick as possible. The tuning time of conventional lengthening rod type tunable filters is on the order of two seconds, primarily due to the large movement of the mass of the mechanical tuning device. Since mass has momentum and must be moved and reversed quickly, to achieve the preferred tuning rates, the movement of any mass in the filter is preferably reduced as much as possible.

This is achieved in exemplary embodiments by providing a tuning mechanism with relatively small movement because it is the capacitance that tunes the frequency adjustment, as shown in FIG. 2, which is produced by tension along rod 214 being acted on by the servomotor 103.

The servomotor 103 can have an encoder attached for precise position feedback, or alternatively be a stepper motor, piezo transducer, or other motion actuator device, such as a high frequency voice coil or solenoid coil (similar to a speaker voice coil) which can be energized and reverse energized at up to 10,000 Hz.

According to the embodiment shown in FIG. 4, manual tuning of the resonant frequency can be performed by rotating the knob 403, which can be knurled and made of steel or another suitable material, fastened on threaded nut 416 that in turn has threads mated to a threaded rod 412, which can, for example, be made of stainless steel. The thread pitch can be selected to achieve a desired sensitivity or responsiveness, for example, a desired rate of change in resonant frequency per rotation of the knob 403. Rotating the knob 403 causes threaded rod 412 and rod 214 and, thus, end cap 107 and disc 105, to move closer to or away from top plate 109, thereby adjusting the capacitance and consequently the resonant frequency of the resonator. Spring pin 417 engages in a grove in shaft collar 112 to constrain threaded rod 412 from rotation and thus rod 214 moves with linear non-rotational motion.

Figure 5:
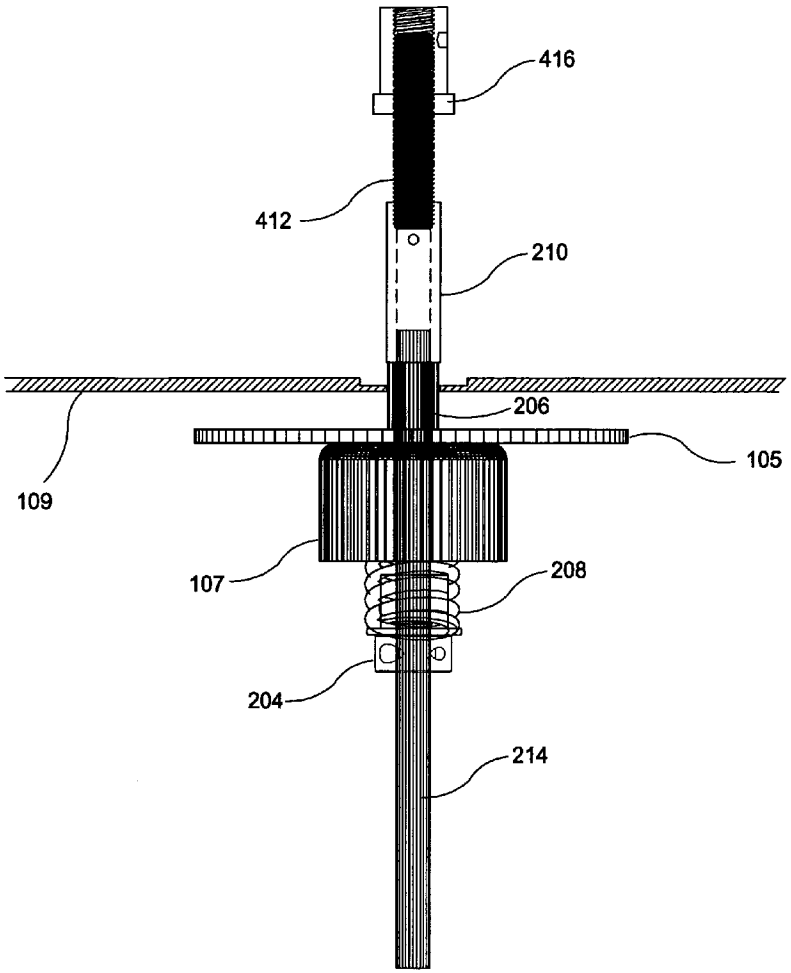
FIG. 5 is an exploded view of the resonator of FIG. 4.
Figure 6:
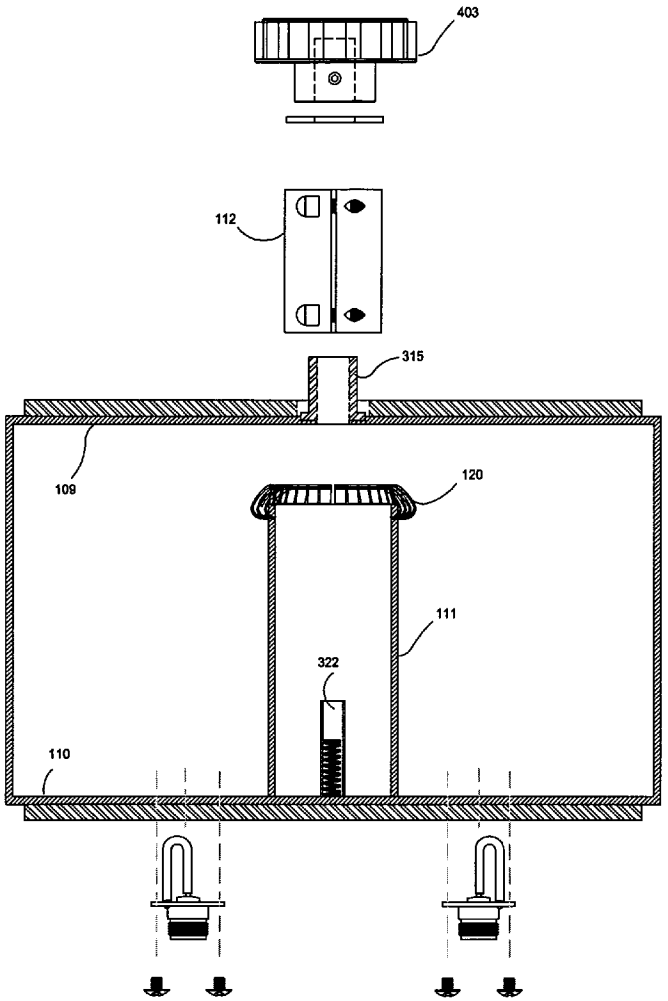
FIG. 6 is an exemplary internal view of the resonator of FIG. 4.

Thermal expansion of the expansion tube 210 can push the ceramic disc 105 and the end cap 107 further away from the top plate 109 and thereby reduce the capacitance to compensate for increased inductance caused by thermal expansion of other components of the resonator, for example, the outer cylinder 117 or inner post 111. In the same fashion as described herein with respect to the exemplary embodiment shown in FIG. 2, in the exemplary embodiment of FIG. 5, the expansion tube 210 will effectively have a greater expansion rate when it is closer to the top plate 109 (and the disc 105 is further from the top plate 109), and if the thermal coefficient of expansion of the tube 210 is greater than that of the spacer 206, this will further help compensate for the non-linear variation of the capacitance with distance between the top plate 109 and the disc 105 and end cap 107 during high RF power applications where high thermal gradients occur on end cap 107 and disc 105. When more of threaded rod 412 is extended closer to the top plate 109 the effect of expansion of threaded rod 412, is greater since it has more length to expand and this variable length of threaded rod 412 compensates for the non-linear variation of the capacitance with distance between the top plate 109 and end cap 107.

For example, as the ceramic disc 105 is moved away from top plate 109, additional length of threaded rod 412 is required to temperature compensate the cavity. This is because there is now less capacitance, so a greater change in distance is required. At very close spacing of ceramic disc 105 to top plate 109, a very small distance change will change the frequency greatly; accordingly, less length is required to effect the temperature compensation. This is achieved in the embodiment of FIG. 4 because under this condition the expansion tube 210 is at the further end of shaft collar 112, the minimum amount of threaded rod 412 is in use giving a near zero differential change in length of expansion tube 210 and spacer 206, versus length of shaft collar 112.

At the lowest tuned frequency, where the end cap 107, disc 105 and top plate 109 are in contact and the spring 208 is sufficiently compressed so there is play between one or more of the disc 105, bushing 206, and expansion tube 210, thermal expansion of the rod 214 will modulate tension in the spring 208 and thereby modulate pressure between the end cap 107, the ceramic disc 105 and the end plate 109 and consequently capacitance of the resonator to compensate for thermally-induced changes in inductance of the resonator. Note that thermal expansion of the bushing 315, shaft collar 112 and nut 416 will tend to increase spring pressure, so expansion of the rod 214 and expansion tube 210 and threaded rod 412 between the nut 416 and shaft collar 204 needs to be greater than expansion of the bushing 315, shaft collar 112 and nut 416 to provide a net reduction in spring pressure with temperature increase. The thermal expansion of the rod 214, when the end cap 107, disc 105 and top plate 109 are in contact, can provide temperature compensation to maintain a particular resonant frequency setting within a specified or desired degree of accuracy over a range of temperatures that the resonator may be subject to. Precise temperature compensation can be achieved over the broadest frequency range.

Figure 9:
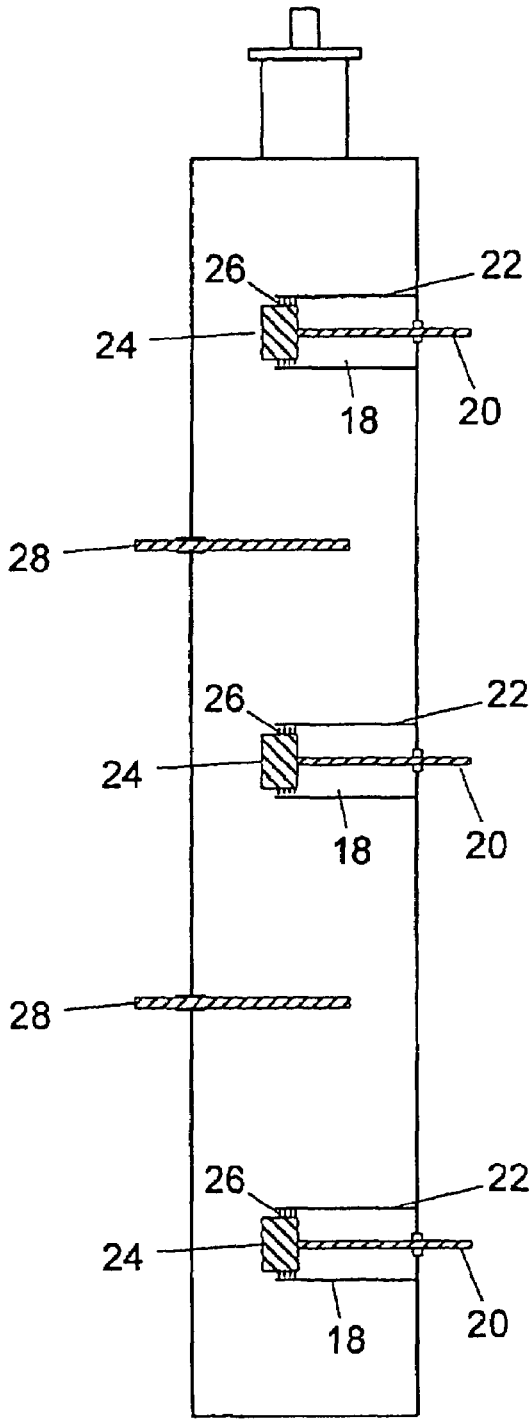
PRIOR ART FIG 9
FIG. 9 is another conventional resonator.

In a conventional tunable evanescent mode cavity as shown in FIG. 9, a number of long screws 20 made of INVAR metal alloy is attached to the top of a conducting center probe extension of the inner post, through the center of the post and extending out of the cavity. Rotating the long screws 20 tunes the resonant frequency of the cavity. In contrast, in an exemplary embodiment as shown in FIG. 4, the tuning nut 403 need only be rotated a few turns to achieve the same result.

A characteristic of conventional TEM resonators is the large gap between the open end of the inner coaxial post to the top ground plate. Accordingly, the frequency is determined based only on the length of the inner post. Therefore, conventional resonators need only compensate for possible expansion/contraction of the inner post. In contrast, the exemplary embodiments of the present application load the post with a ceramic dielectric disc 105 thereby forming a capacitor.

Figure 13:
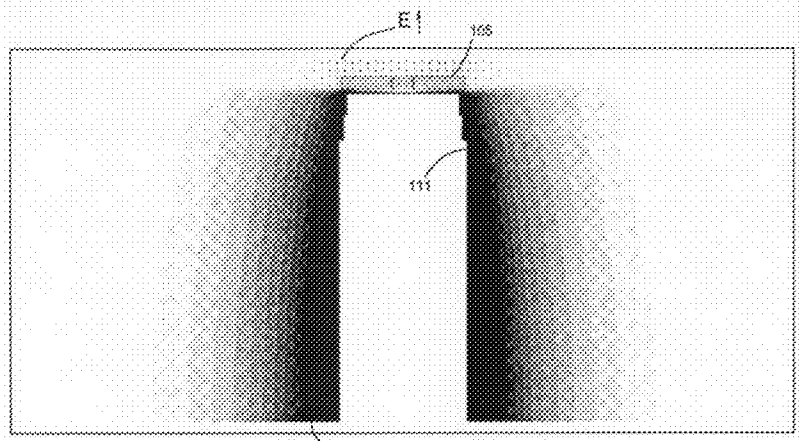
FIG. 13 illustrates the Electric field (E) and Magnetic field (H) in the cross section of a non-evanescent mode loaded cavity according to an exemplary embodiment.
Figure 14:
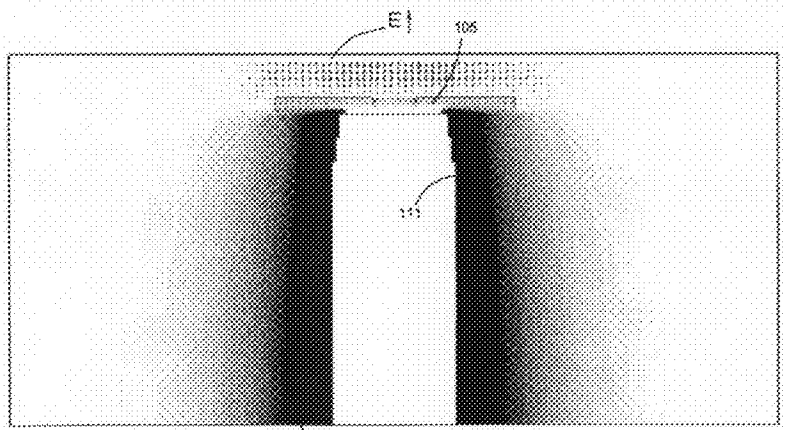
FIG. 14 illustrates the Electric field (E) and Magnetic field (H) in the cross section of an evanescent mode loaded cavity according to an exemplary embodiment.

Within the ceramic disc 105 the electric field is vertical (extending from the end cap to the top plate) and the magnetic field is circular, axially symmetric and parallel to the conductive surfaces of end cap 107 and top plate 109 with current flowing on the surface of the end cap 107 along the path from the inner hole to the outer diameter perpendicular to the magnetic field. These fields are analogous to a cylindrical cavity (except there are no side walls), which in general has a Q proportional to the volume-to-surface area ratio. The outer diameter and thickness of the ceramic disc must be chosen to be below cutoff frequency at its first dielectric resonator mode, which frequency is approximately 800 MHz for a disc with 2 inch radius, 0.4625 inch thickness, and dielectric constant of 43. The inner diameter is sized to allow non-conductive rod 214 to pass thru it. The thickness dimension is less than its diameter in this case, although it does not have to be. The surprising effect of using a 4 inch diameter disc 105 which is greater than the 2 inch diameter end cap 107 is that the electric field E is spread out over the entire disc, not just over the 2 inch diameter of end cap 107, where it would be expected from a TEM mode field analysis. In comparing FIG. 13 having a small diameter disc versus FIG. 14, which has the evanescent mode disc 105, the electric field E extends much further than end cap 107 and the magnetic fields H are more uniform along the length of the post 111. In fact, this electric field E is very similar to the TM mode of the dielectric resonator, except it is unidirectional, whereas in the TM mode it is dipole like, i.e., on one side directed toward the top and the other side opposite. This dramatically increases the volume for energy storage of the electric field E, and therefore increases the Q.

Although some fringing capacitance exists from the outside surface of the end cap 107 to the top plate 109 without going through the ceramic disc 105, it is small relative to the ceramic capacitance, its net effect can be combined in with the ceramic capacitance when choosing a temperature coefficient of dielectric constant for the ceramic disc 105.

The dielectric increases the current densities on the surface of the end cap 107 and top plate 109, where the ceramic disc 105 is the dielectric between them. This increased current density causes higher loss because of the presence of the dielectric. As such, it is beneficial to consider the Q of the loading capacitance not just by the dielectric Q, but also by the conductivity of the end cap 107 and the top plate 109 in contact with or near the loading capacitance. Even if there were no ceramic disc, the Q would be affected, because the net capacitor Q equals the product of the dielectric Q and of the conductor Q divided by the sum, in which case the capacitor Q is due solely to the losses from the end cap and top plate currents. However, with the large apparent area of the electric field E caused by the evanescent mode dielectric resonator disc 105, this effect is mitigated, and the current density is reduced compared to a smaller disc.

In exemplary embodiments, there is preferably no thin film plating or silver firing on the ceramic disc 105 itself, as these materials have lower conductivities and can cause high losses. In addition, the tuning method is made either fixed or mechanically slow because of the problems associated with rotating exposed plate areas against unexposed areas of bare ceramic.

There can be a trade-off in selecting the dielectric constant of the material for the loading capacitor 105, because a high dielectric constant gives increased capacitance at the expense of increased current density and thus loss on the plates of the end cap 107 and the top plate 109, even if the ceramic disc is in the evanescent mode. However, a low dielectric constant does not achieve the benefit of reducing the post length 111. In an exemplary embodiment, the dielectric constant of the ceramic disc 105 is 43 and the material composition of the ceramic disc 105 is ZrZn TiNb or similar material.

It can be desirable to reduce the length of the coaxial inner post 111 as short as possible, for example to make the resonator more compact. One solution is to reduce the thickness of the ceramic 105 to increase the capacitance and thereby allow for the length of the post 111 to be shortened. However, there are two detrimental effects in doing so, the first being a reduction in the Q of the capacitor (reduced volume or not being in the evanescent mode) and the second being a reduction in the flashover voltage handling. To have high power handling and high enough Q, in an exemplary embodiment the ceramic disc 105 has a sufficient thickness, for example on the order of approximately 6 millimeters which can allow the resonator to handle at least 1000 Watts.

The ceramic disc 105 can be provided with a larger diameter to provide a corresponding larger surface area and thereby increases the capacitance and Q by reducing the current density and increasing volume, but too large a diameter can lead to difficulty in maintaining flatness and may induce bending stresses to the point of cracking the ceramic during high speed tuning. Sufficient contact area for contacting surface of the end cap 107 is required to conduct heat away from the ceramic as well. In an exemplary embodiment of the present invention, the ceramic disc 105 has a diameter of 4 inches. Of course, the diameter can not be too large to exceed the evanescent mode requirement.

As mentioned, current flows on the surface of end cap 107 along the path from the inner hole to the outer diameter and equally on the interior surface of the top plate 109, parallel and outwardly from hole in the top plate 109 through which the spacer 206 passes toward the outer conductor 117. The current on the top plate 109 travels a distance more than that on the end cap 107. This distance from the edge of end cap 107 to the inside edge of the outer conductor 117 and down the outer conductor 117 to a height of the top of the end cap 107 (which top is adjacent to the disc 105) thus appears as an impedance to the capacitor in the return path. Heating of the outer conductor 117 and top plate 109 increases this current path length due to thermal expansion and if uncompensated, would cause a lowering of the resonant frequency of the resonator.

Expansion of the outer conductor 117 length forces the top plate 109, and thus ceramic disc 105, and end cap 107, to move away from the bottom mounting plate 110. The end cap 107 extends the contact fingers 120 attached to the inner post 111. The end cap 107 moves up but does not change the total length of the coaxial line, which is the surface length from the top of end cap 107 thru contact fingers 120 along post 111 to the bottom mounting plate 110 shown for example in FIGS. 1 and 4, thereby not being affected so rapidly to a sudden change in the outer ambient environment, such as an air conditioner fan being turned on suddenly blowing cold air on the outside of the cavity.

Since the inner post 111 is directly connected to the end cap 107 thru soldered connections of the spring fingers 120 in an exemplary embodiment, in a preferably direct thermal connection to the ceramic disc 105, the ceramic disc's thermal dielectric coefficient can be selected to at least partially compensate for the expansion of the end cap 107 and length expansion of the inner post 111. This overcomes the limitation of the prior art resonators' inability to temperature compensate under high RF heating conditions. In conventional cavities, long thermal paths exist between external compensating structures and the source of the RF induced heating, which is near the open end of the long inner post.

In an exemplary embodiment, the ceramic disc 105 preferably has a linear coefficient of expansion of about +8 ppm/degree Centigrade (° C.), thus increasing in area and thickness with temperature. However, if the dielectric constant of the ceramic is chosen to have a temperature coefficient of about −26 ppm/° C., the capacitance of the ceramic disc 105 is reduced with increasing temperature enough to compensate itself, causing no frequency shifting due to the ceramic disc 105.

Thermal expansion coefficients of the non-conductive spacer 206, and rod 214 (which can both be made out of a single piece of ceramic, for example.), can be well matched to the ceramic disc 105 material expansion, for example, by having a +7 to +8 ppm/° C. expansion coefficient. In an exemplary embodiment, thermal expansion coefficient of a stainless steel threaded rod 412 has preferably a +16 ppm/° C. linear coefficient of expansion, a steel housing 219 of servomotor 103 and a steel locking shaft collar 112 preferably have a +10 ppm/° C. linear coefficient of expansion. An aluminum expansion tube has a +23 ppm/° C. expansion coefficient.

In an exemplary embodiment, the length of the expansion tube 210 and the spacer 206 are empirically adjusted so that nearly exact thermal frequency compensation is obtained. This is because the ceramic disc 105 is made with temperature coefficients within certain tolerances. Expansion of the holding mechanism can be made to either increase or reduce pressure on the ceramic disc 105 with a change in temperature in the case of lowest frequency, and either increase or reduce distance of the ceramic disc 105 to the top plate 109, with a change in temperature, and thus additionally correct for any deviation to the compensation provided by the ceramic disc 105.

In exemplary embodiments, thermal path lengths are as short as possible to keep the temperatures of the resonator stable at high power conditions, for example, 1,000 Watts, and under varying ambient conditions. This is achieved in exemplary embodiments because the end cap 107 is in direct thermal contact with the ceramic disc 105, which is in direct contact with the spacer 206. Spacer 206 contacts the expansion tube 210 within bushing 315 attached to top plate 109. Thus, rapid thermal dissipation occurs from the end cap 107 to the top plate 109 to the outer conductor 117 and the mounting plate 110.

As a result, all temperature effects on the outer plate 109, the ceramic disc 105, the end cap 107, the inner post 111, in addition to the outer conductor 117, are accounted for in order to stabilize the frequency of the resonator 100 over a broad range of temperatures, for example, from −30° C. to +60° C. even while high RF power (for example, 1,000 Watts or more) is being applied to the resonator 100.

Figure 10:
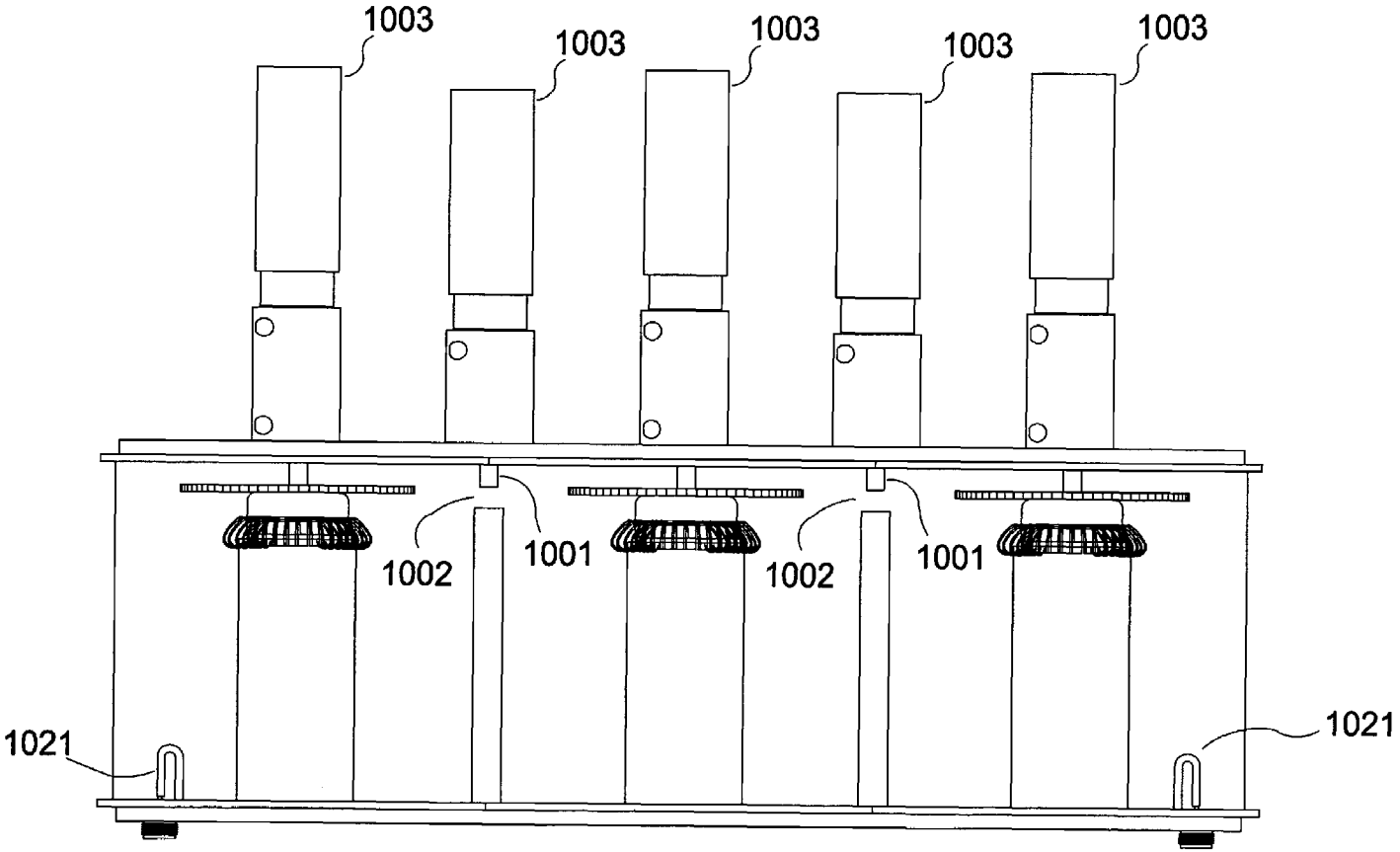
FIG. 10 is a multi-section tunable filter in accordance with an exemplary embodiment.

In an exemplary embodiment as shown in FIG. 10, the bandwidth is also controlled by servomotors 1003 attached to tunable screw 1001, so tunable screw 1001 can be used to adjust the bandwidth, or the amount of coupling between resonators A, B, or C by adjusting either one of apertures 1002 or both. Each of servomotors 1003 can be individually controlled. In a diplexer or duplexer arrangement, constructed of adjacent assembled cavities or fabricated out of a single housing, servomotors 1003 control all resonators A, B and C, and their coupling, allowing a multitude of transmit and receive frequencies and bandwidths.

In an exemplary embodiment, the rotatable coupling loops 121 and 1021, shown for example in FIGS. 1 and 10, respectively, are adjusted and then secured tight against mounting plate 110, for example via screws 123, to give the desired bandwidth and voltage standing wave ratio (VSWR). In an exemplary embodiment that uses a electromagnetic coil in place of the servo motor 103, a single saw-toothed shaped pulse of current is passed thru the electromagnetic coil 103, and swept with a network analyzer, the frequency of the output of the network analyzer being recorded with the exact voltage and current applied to the coil.

A calibration curve is thus obtained of the drive current vs. frequency. Because the cavity 100 is stable with temperature, only one calibration curve is needed. The curve can be stored, for example, in a computer and can be used by a simple program to adjust the resonant frequency of the resonator 100 device to desired values.

The coil 103, is subject to a steady temperature rise as in any electromagnet, however this can be easily measured with a thermistor attached to the body of the electromagnet 103, calibrated and integrated or accounted for within the control program for the coil in use. This keeps the thermistor in the drive power control loop of the controller; no closed loop control of the center frequency is required.

The control drive outputs the control voltage to the coil and the resonator is then at the associated calibration frequency. This is a great improvement over prior art controllers that require sampling of the RF signal in order to lock on to a specified frequency. In fact, exemplary resonators in accordance with the present invention can be set to a frequency without an RF locking signal being applied and can thus be used for receiving as well as transmitting modes, because they can be set to whatever frequency is commanded. Sampling can be problematic when, in a receiving mode, because in order to obtain a sample an RF signal must be transmitted using the resonator, at a time when the resonator should be used to listen or receive instead of transmit. Exemplary embodiments of the present invention avoid this problem completely by not requiring sampling of the RF signal.

If in the field the coupling loops 121 need adjustment, and thus detune the resonator 100 from an initial setting, the locking shaft collar 112 can be carefully readjusted to recapture the initial setting.

A use of the described exemplary embodiments is to obtain a frequency offset. This offset is required in repeater radio links, where transmit frequency is offset from the receiver frequency. By using the device in this radio application, a single filter can be used for transmit and receive, replacing the very costly and bulky duplexer normally used. In this implementation, the filter is connected to the antenna, followed by a transmit/receive switch. In either receive or transmit mode, the filter can be quickly tuned to the desired frequency.

Figure 11:
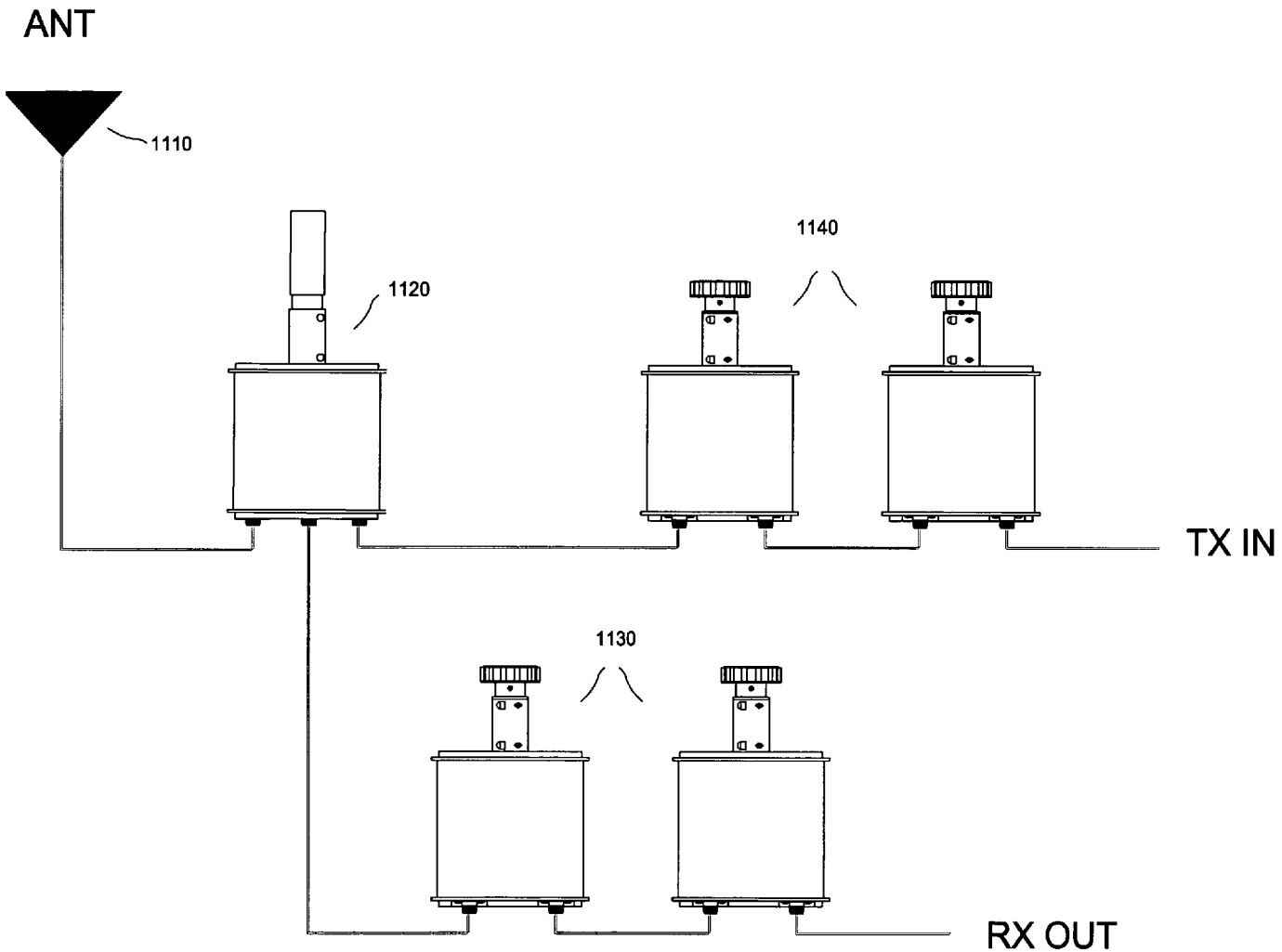
FIG. 11 is a radio front end configuration for tunably receiving and transmitting.

And a further implementation of the exemplary embodiments is shown in FIG. 11, which eliminates the transmit/receive switch (T/R switch). The T/R switch can be problematic for high power applications, and typically has a short lifetime due to the high handling power and use of mechanical contacts. In this exemplary embodiment, the antenna 1110 is connected to a single tunable filter 1120, the filter 1120 has two other connectors, one for receive filters 1130 and the other for transmit filters 1140. By tuning the cavity of tunable filter 1120 to the transmit frequency, power that can pass through the filter 1120 is reflected at the receive connector by the receive filters 1130 and passes through the antenna 1110. Likewise tuning to the receive frequency, reception from the antenna 1110 is filtered by the tunable filter 1120 at the tuned receive frequency and reflected at the transmit connector by the transmit filters 1140 and passes through the receive filters 1130. The tunable filter 1120 adds filtering for both transmit and receive functions, eliminates the T/R switch, and eliminates one cavity filter from the usual configuration of three receive and three transmit cavities.

For use as a simple duplexer, cavity filter 1120 can have a bandwidth wide enough to allow both receive and transmit signals to pass through simultaneously, and because of the wider bandwidth has a lower insertion loss. A transmitter and antenna 1110 are connected to the cavity 1120 along with a single receiver filter 1130 (transmitter filters 1140 not being used in this case, for example). A single receive filter 1130 tuned to the receive frequency blocks the transmitter power from entering the receiver while receiving from the antenna 1110 through tunable filter 1120. Transmitter power is filtered by tunable filter 1120 and transmits to antenna 1110 while antenna 1110 simultaneously receives signals which pass through filter 1120 and receive filter 1130 to the receiver. Alternatively, transmit filters 1140 can be used to tune to a particular transmit frequency. In addition, any number of filters 1130 and 1140 can be added for additional tuning capability.

In the exemplary embodiments described herein, the loaded shortened transmission line does not produce a second passband frequency until many times the center or resonance frequency of the filter or resonator. This provides great benefit by avoiding responses to out-of-band interference signals or preventing those out-of-band signals from passing through the filter. Thus, exemplary embodiments can be especially beneficial when used in direct conversion receivers. The filter and local oscillator (LO) synthesizer can be tuned to produce a single constant intermediate frequency (IF) directly from the RF signal avoiding multiple down conversions. This is not possible in fixed tuned filters, as the bandwidth of the filter has to be wide enough to allow passage of multiple channels, in which the LO synthesizer is tuned to select a specific channel to down convert, the interfering image of the desired channel would also be present at the IF. By being able to tune the narrow band filter and LO synthesizer to only one RF channel, the undesired image is rejected, which eliminates at least one down conversion stage within the receiver.

By suitable selection of cables and rotatable coupling probes, a notch filter, duplexer, diplexer, and combiner, or multiple bandpass or a bandpass with notch filters can all be fabricated using an exemplary embodiment, and can all be tunable. Multiple resonators in accordance with the present invention can be constructed within a single housing with aperture coupling to form a multi-section filter.

Figure 12:
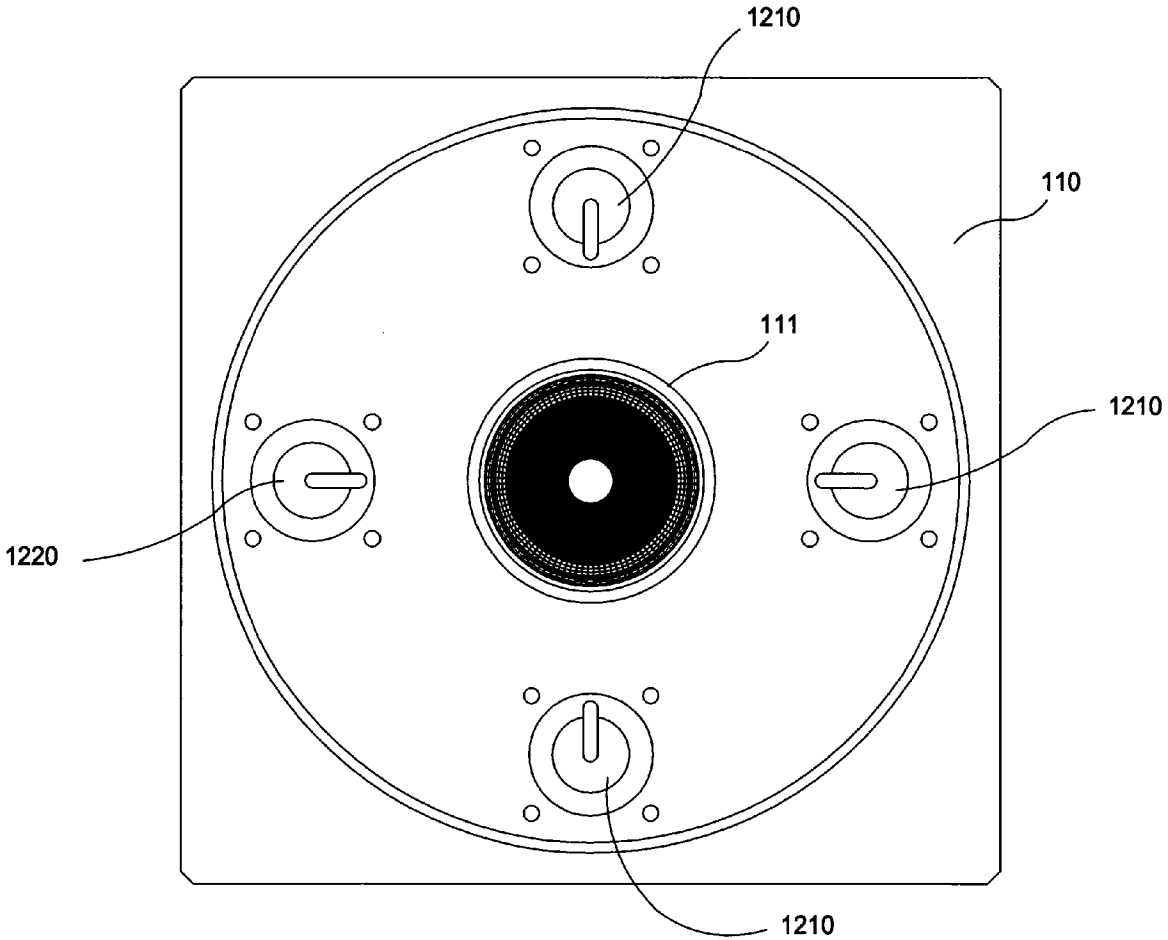
FIG. 12 illustrates plural connections within a cavity resonator according to another exemplary embodiment.

By utilizing multiple connections within a cavity resonator 1200, as shown in FIG. 12, for example, three connections 1210 and one antenna connection 1220, the cavity can be utilized to form a combiner having a very wide tuning range, and if transmitted or received signals are time division multiple accessed, systems can then utilize a single antenna for various signal transmissions on a time shared basis, replacing the multitude of antennas used. For example, transmitting a voice message for a 200 msec interval at 100 MHz, then receiving a control code at 200 MHz, followed by transmitting another voice channel for 200 msec intervals or packets at 300 MHz. This eliminates the very high signal losses that are incurred in the past when a multi-octave hybrid combiner is used to combine transmitters to a common antenna, so long as they can be time segregated.

Multiple resonators or filters in accordance with exemplary embodiments can be singly tuned or gang tuned. A computer such as a personal computer or micro controller can run or operate multiples of filters, each filter having its own controller driver, such as servomotors 103 and 1003, and the computer commanding each individual controller and associated cavity on a time division multiplex scheme. Alternatively, a computer and controller can be individually provided with each resonator/filter, simply set to a frequency, and can be externally networked to allow control commands for the filter be sent from a different location.

The invention has been described with reference to particular embodiments. However, it will be readily apparent to those skilled in the art that it is possible to embody the invention in specific forms other than those of the preferred embodiments described above. This may be done without departing from the spirit of the invention.

Thus, the described embodiments are merely illustrative and should not be considered restrictive in any way. The scope of the invention is given by the appended claims, rather than the preceding description, and all variations and equivalents, which fall within the range of the claims, are intended to be embraced therein.

I claim:

1. A resonator, comprising:

an inner conductive post within a conductive cavity with a first end of the inner conductive post in electrical contact with an inner surface of the cavity;

a movable, conductive end cap positioned near a second end of the inner conductive post and in electrical contact with the inner conductive post;

a ceramic disc in contact with the movable conductive end cap between the movable conductive end cap and an inner surface of the cavity; and a movable non-conductive rod passing through the inner conductive post and the movable conductive end cap and the ceramic disc that changes the frequency of the resonator based upon the movement of the movable non-conductive rod acting on the movable conductive end cap.

2. The resonator of claim 1, wherein the movement of the movable non-conductive rod increases or decreases the contact pressure between the moveable conductive end cap and the ceramic disc.

3. The resonator of claim 2, wherein a spring determines the amount of contact pressure between the moveable conductive end cap and the ceramic disc based on the movement of the movable non-conductive rod.

4. The resonator of claim 1, wherein the movement of the movable non-conductive rod is controlled by a servo motor or solenoid acting on the movable non-conductive rod, thereby selecting the frequency of the resonator.

5. The resonator of claim 1, wherein the ceramic disc is an evanescent mode dielectric resonator.

6. The resonator of claim 1, wherein the distance between the moveable conductive end cap and the inner surface of the conductive cavity adjusts with temperature to maintain a resonance frequency within 2 parts per million/C for at least one frequency.

7. The filter of claim 1, wherein a second resonance of the cavity is greater than three times a lowest resonant frequency.

8. A Duplexer for receiving and transmitting including at least two cavity filters, comprising:

a first cavity of the at least two cavity fillers configured as a receive filter having a receive connector and a coupling to a second cavity filler;

a second cavity of the at least two cavity filler configured as a filter having a transmit connector and an antenna connector and a coupling to the first cavity;

wherein the frequency of the second cavity is adjustable for reception and transmission and the frequency of the first cavity is adjustable for reception.

9. A device for receiving or transmitting, comprising:

a first cavity of at least three cavities configured as a receive filter having a receive connector;

a second cavity of at least three cavities configured as a transmit filter having a transmit connector;

a third cavity of at least three cavities tunable for reception or transmission of particular radio frequencies, based on the movement of a movable rod acting on a movable conductive end cap, the third cavity coupled to the first cavity and the second cavity and having an antenna connector;

wherein the frequency of the third cavity is adjustable for reception or transmission.

* * * * *